United States Patent [19]

Busch

[11] Patent Number: 4,621,607

[45] Date of Patent: Nov. 11, 1986

[54] FULL FIST ARROW RELEASE

[75] Inventor: Lynn H. Busch, R2, Algoma, Wis. 54201

[73] Assignee: Lynn Harlan Busch, Algoma, Wis.

[21] Appl. No.: 677,468

[22] Filed: Dec. 3, 1984

[51] Int. Cl.[4] ..... F41C 19/00; F41B 5/00

[52] U.S. Cl. ..... 124/35 A; 124/90

[58] Field of Search ..... 124/35 A, 90, 91, 23 R, 124/24 R

[56] References Cited

U.S. PATENT DOCUMENTS 3,010,446 11/1961 Frantello ..... 124/86

3,847,133 11/1974 Awiszus ..... 124/91

OTHER PUBLICATIONS

Archery, vol. 41, No. 4, Apr., 1969; pp. 14, 15 and 33.

*Primary Examiner*—Richard C. Pinkham

*Assistant Examiner*—Benjamin Layno

[57] ABSTRACT

An arrow release for receiving a bow string and an arrow nock. The arrow release is made of light weight durable material, preferably buckskin. An elongated strip of such a material is doubled together and stitched together forming a crease at one end of the arrow release for receiving a bowstring. This structure allows the arrow release to be attached to the bowstring at all times. A slit formed in the creased portion of the arrow release is adapted to receive an arrow nock. The opposite end of the arrow release may be grasped by the full fist of the user, then pulled back drawing the bowstring to a full draw position. The arrow may then be shot when the grip of the user is relaxed, releasing the arrow release.

3 Claims, 4 Drawing Figures

FULL FIST ARROW RELEASE

BRIEF SUMMARY

This release is made of light-weight durable leather. The release is uniquely structured such that it is the only release of its kind that is attachable to a bowstring and remains on a bowstring at all times. The release also has sufficient length such that it may be grasped by all five fingers (full fist) of the shooting hand.

DETAILED DESCRIPTION OF PREFERRED EMBODIMENT OF THE INVENTION

This release is made with a piece of tanned buckskin (with hair removed), 3.5 mm. thick, 2.5 cm. wide and 26 cm. long. Other materials may be used but the materials' texture and mass should be comparable to that of buckskin.

Figure 1:
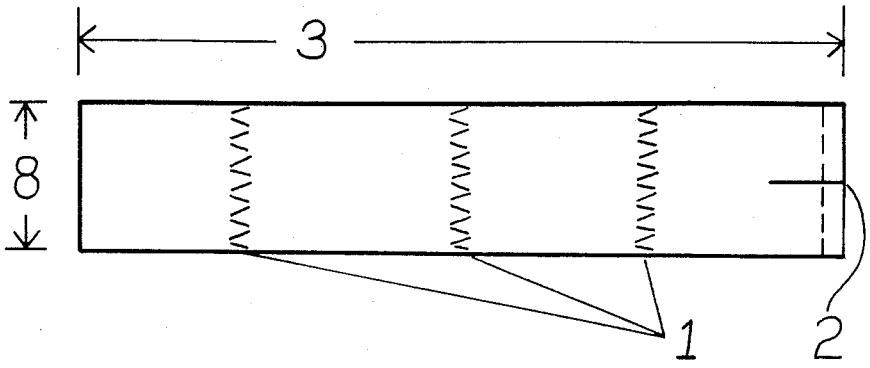
FIGS. 1, 2, and 3 shows the plain front end and top views in full scale.
Figure 2:
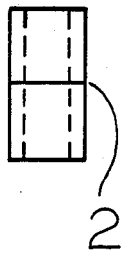
Figure 3:
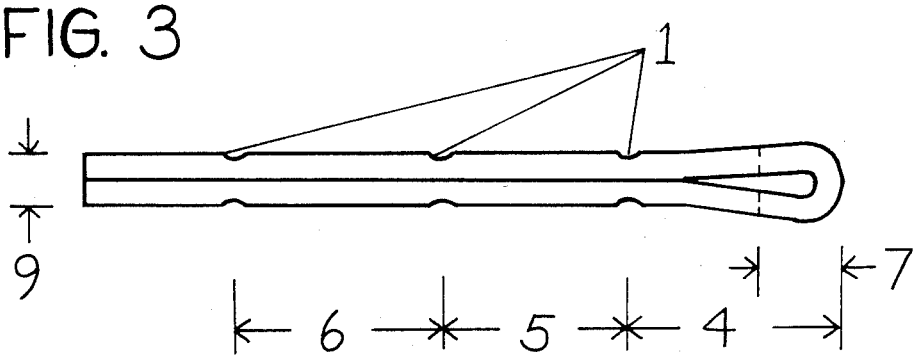
Figure 4:
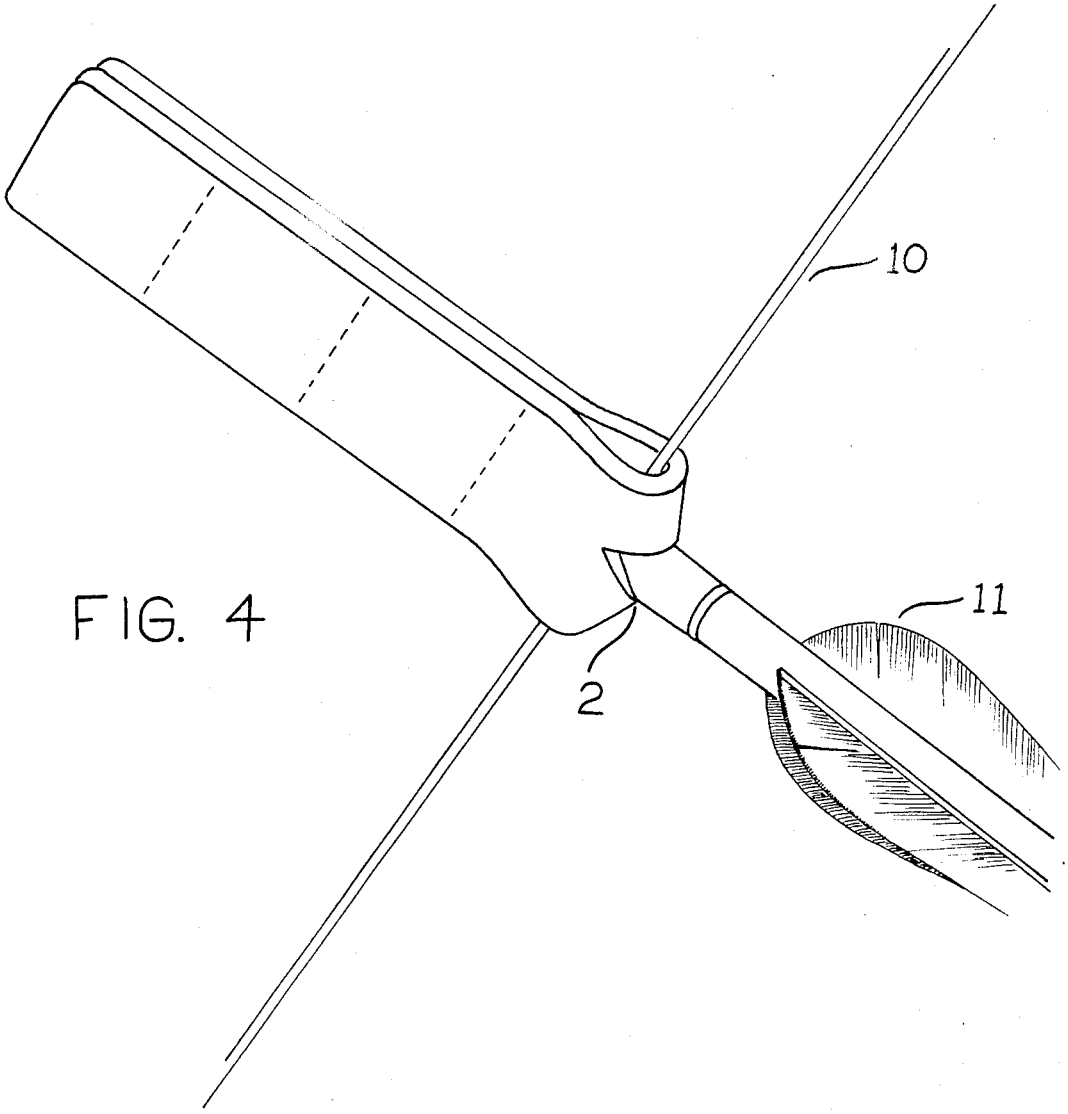
FIG. 4 shows how the invention is to be used with respect to the bowstring and the placement of the arrow.

The leather (with the smooth side out) is first doubled together to form a release having a length of 13 cm. 3, a width of 2.5 cm. 8, a thickness of 7 mm. 9 and weight approximately 10 grams. The doubled together portions are then sewn together at three spots 1 using string that has a tensile strength of approximately 16 kg. The stitching should be done across the width of the leather. The first stitch should start about 3.5 cm. 4 from the creased end. The second and third stitchings should be 3 cm. 5 and 3.5 cm. 6 from the first respectively. A slit 2 is then cut in the creased part of the leather and should be 1.25 cm. 7 long. The pre-sewn strap is then slid over the bow string 10, through the creased end of the strap prior to stringing the bow. After the bow is strung, the arrow is then nocked through the slit 2 and then to the bowstring at its normal location. The detail of this is illustrated in FIG. 4.

To use the full fist arrow release, the shooter first grasps the leather strap. After drawing the bow back, the arrow is then released by just opening the hand and letting the release slide out in one smooth action.

I claim:

1. A full fist arrow release capable of receiving a bow string and an arrow nock, and capable of being grasped by the full fist of a user for drawing the bow string back and upon opening the user's hand, releasing the arrow, said full fist arrow release comprising, an elongated strip of material doubled together forming a crease along its width, resulting in a first end and a second end;

said first end comprising two contiguous end portions of said elongated strip, and fastening means for securing together said end portions;

said second end comprising an opening formed between said fastening means and said crease, said opening having an axis extending along the width of said strip, said crease provided with means for receiving the nock of an arrow such that the nock extends through the strip at said crease and into engagement with a bow string;

said opening adapted to receive a bow string therethrough for securing said arrow release to the bow string;

said first end adapted to be grasped by the full fist of a user.

2. The arrow release of claim 1 wherein said elongated strip is made from buckskin leather.

3. The arrow release of claim 2 wherein said fastening means is stitching.

* * * * *